US007568555B2

(12) United States Patent
Vroegindeweij et al.

(10) Patent No.: US 7,568,555 B2
(45) Date of Patent: Aug. 4, 2009

(54) RAIL SYSTEM FOR A STAIRLIFT WITH MOVABLE END SECTION

(75) Inventors: Dennis Vroegindeweij, Hoofddorp (NL); Martinus J. Hester, Heerhugowaard (NL)

(73) Assignee: Freelift B.V., Heerhugowaard (NL)

( * ) Notice: Subject to any disclaimer, the term of this patent is extended or adjusted under 35 U.S.C. 154(b) by 394 days.

(21) Appl. No.: 10/482,717

(22) PCT Filed: Jun. 20, 2002

(86) PCT No.: PCT/NL02/00406

§ 371 (c)(1),
(2), (4) Date: Jul. 19, 2004

(87) PCT Pub. No.: WO03/004399

PCT Pub. Date: Jan. 16, 2003

(65) Prior Publication Data

US 2004/0238286 A1 Dec. 2, 2004

(30) Foreign Application Priority Data

Jul. 3, 2001 (NL) ..... 1018443

(51) Int. Cl.
*B66B 9/08* (2006.01)

(52) U.S. Cl. ..... 187/201; 187/200

(58) Field of Classification Search ..... 187/200–202
See application file for complete search history.

(56) References Cited

FOREIGN PATENT DOCUMENTS

| | | | | |
|---|---|---|---|---|
| EP | 450858 | A2 | * | 10/1991 |
| GB | 2 296 908 | A | | 7/1996 |
| GB | 2296908 | A | * | 7/1996 |
| WO | WO 9008091 | A1 | * | 7/1990 |
| WO | WO 97/26207 | A1 | | 7/1997 |
| WO | WO 9726207 | A1 | * | 7/1997 |
| WO | WO 9942399 | A1 | * | 8/1999 |
| WO | WO 03004399 | A1 | * | 1/2003 |
| WO | WO 2004108578 | A1 | * | 12/2004 |

* cited by examiner

*Primary Examiner*—Peter M Cuomo
*Assistant Examiner*—Eric Pico
(74) *Attorney, Agent, or Firm*—The Webb Law Firm

(57) ABSTRACT

The invention relates to a guide along a staircase, along which a carriage of for instance, a stair walking aid or a stair lift is displaceable. This can herein comprise at least one elongate tube and engaging means for the carriage, wherein the tube comprises a stationary segment and at least one tiltable segment which are connected by means of a tilting mechanism in order to tilt the tiltable segment selectively away from and to a position lying in the line of the stationary segment, wherein the tilting mechanism is situated substantially in the interior of at least one of the tiltable segment and the stationary segment.

9 Claims, 3 Drawing Sheets

RAIL SYSTEM FOR A STAIRLIFT WITH MOVABLE END SECTION

BACKGROUND OF THE INVENTION

1. Field of the Invention

The present invention relates to a guide along a staircase, along which for instance a stair lift or a stair walking aid can be guided. Such a guide is disposed along the staircase, such as a stair lift, although the invention is not limited hereto. The guide is used to guide there along for instance a carriage or a stair walking aid. The carriage serves for instance as chair for transporting a person, as in the case of the above mentioned example of a stair lift.

2. Description of the Prior Art

According to the known art the guide can be formed by a single tube having thereon engaging means for the carriage which must displace along the guide in the form of a tube. It is also possible for more than one guide, for instance in the form of a tube, to be arranged.

A drawback of the known art is that for proper functioning of the carriage a guide in the form of a tube necessarily extends in areas where it can form a hindrance to other people. For instance in the case of a stair lift, a guide in the form of a tube extends at the bottom of the staircase into a hallway, where it forms an obstruction. Such an obstruction can even be an obstacle when there is the danger of someone walking past catching on it. Such a drawback is even considerable when it is considered that a user of for instance a stair lift usually has problems walking. The guide of the stair lift, which serves as aid in ascending or descending a staircase, thus forms a considerable hindrance to this same user.

SUMMARY OF THE INVENTION

The present invention has for its object to alleviate or even obviate the above stated drawbacks, for which purpose the guide in the form of a tube comprises a stationary segment and at least one tiltable segment which are connected by means of a tilting mechanism in order to tilt the tiltable segment selectively away from and to a position lying in the line of the stationary segment, wherein the tilting mechanism is situated substantially in the interior of at least one of the tiltable segment and the stationary segment. In preference the tiltable segment is herein precisely that part of the guide in the form of a tube which can form an obstacle in for instance a hall in the case of a stair lift. By making tiltable precisely this part of the guide in the form of a tube, this part can be folded away, preferably against the stationary segment, so as to no longer form a potential obstacle.

Because the tilting mechanism is incorporated internally in the guide, the tilting mechanism itself does not impede the operation of the components co-acting therewith, such as the stair walking aid or the stair lift. In a new and inventive guide and device according to the present invention the fact that the tilting device is incorporated integrally into the guide is highly advantageous. There are no components outside the guide which would take up space, and the provided solution is therefore very compact and robust. Optimum safety is moreover provided in that the tilting device is accommodated integrally in the guide, wherein users cannot therefore hurt or injure themselves on protrusions which would form part of the tilting device. It is precisely because the tilting mechanism is so compact and robust that it can also find application at positions along the guide other than just at a location where a part of the guide is placed protruding in obtrusive manner into a passageway such as a hall or a corridor. The tilting mechanism can thus be arranged at any random position along the guide where, for whatever reason, there is a need therefor.

A guide according to the present invention has a diversity of favourable embodiments which will become apparent or which will be described explicitly hereinbelow, and some of which are defined in the dependent claims.

In a first embodiment the tilting mechanism comprises a rotary motor for driving a tilting arm connected to the motor via a planetary gear system. Through the use of the planetary gear system a relatively very light motor is sufficient and the rotational movement about the rotation axis generated by the motor is converted into a rotating or tilting movement of the tilting arm about a tilt shaft which is approximately at right angles to the rotation axis of the motor. It is however also possible within the scope of the invention to opt for another solution wherein use is for instance made of a screw spindle, which transmits the tilting movement to the tiltable segment via a rod construction. Nor is an embodiment precluded wherein use is made of a memory material to predefine the positions of the tiltable segment.

In a further preferred embodiment there can be arranged between the stationary segment and the tiltable segment a tilt shaft around which the tiltable segment is tiltable relative to the stationary segment. As alternative a hinge can for instance be used, although with correct dimensioning of a tilt shaft a much closer fitting of the tiltable segment to the stationary segment can be realized in the folded-away position of the tiltable segment.

In a very favourable embodiment the tilting mechanism comprises a housing which fits on one side into the tiltable segment and on the other side into the stationary segment, or is at least connected thereto, and with an intermediate part, the external form and dimensions of which correspond with those of the segments. A modular construction is thus possible, the strength, durability etc. of which does not depend on the strength of the inner walls of the guide (when the tilting mechanism is placed directly into one of the segments), but which is related to the strength of the housing. The modular construction enables a simple assembly, wherein the housing of the tilting mechanism need only be fixed in the stationary segment and in the tiltable segment in order to complete assembly. It is herein possible that narrowed portions on either side of the intermediate part have an external form and dimensions corresponding with the a internal form and dimensions of the segments, so that the housing 11 fits into the segments. It is otherwise noted that if the external form and dimensions of the housing of the tilting mechanism correspond with those of the stationary segment and the tiltable segment (the latter two also being the same as each other), a stair lift or stair walking aid can, without any measures, move over the intermediate part of the housing at the transition between the stationary segment and the tiltable segment with this intermediate part therebetween.

The housing then preferably comprises narrowed portions on either side of the intermediate part with an external form and dimensions corresponding with the internal form and dimensions of the segments. Thus can be achieved that the housing, or at least the opposite outer ends thereof, each fit into one, of the segments.

Such an intermediate part of the housing can also form the separating boundary between the stationary part of the guide and the tiltable segment if the housing comprises two housing parts arranged tiltably on each other. It will be apparent to a skilled person that such a configuration is very simple to assemble, wherein the housing having therein the tilting mechanism is supplied as modular unit and can be readily assembled on-site.

In an embodiment with a tilting arm the intermediate part or one of the segments can comprise at least one passage 19 to allow through this tilting arm during a pivoting movement of the tiltable segment 10. A greater freedom of movement for the tilting arm is hereby provided, as also for the pivoting range of the tiltable segment.

This tilting range can preferably be so large that, irrespective of the chosen embodiment of the tilting mechanism, the tiltable segment lies against the stationary segment in the folded-away position. In such a situation lying against the stationary segment the tiltable segment is removed as far out of sight and out of the way as possible in the stairwell, and so forms the least possible hindrance, both for the passer-by and visually.

Since the properties, advantages and features of the guide are unequivocally linked to those of the whole obliquely running lift, the present invention also relates per se to a device for transporting persons and goods along a staircase, which comprises a carriage and a substantially stationary guide, wherein the carriage is displaceable along the guide and the guide is one as will be described hereinbelow in more detail.

BRIEF DESCRIPTION OF THE DRAWINGS

The invention will be further elucidated hereinbelow in the light of a description and with reference to the annexed drawings, in which the same or similar parts and components are designated with the same reference numerals, and in which.

DETAILED DESCRIPTION OF THE INVENTION

Figure 1:
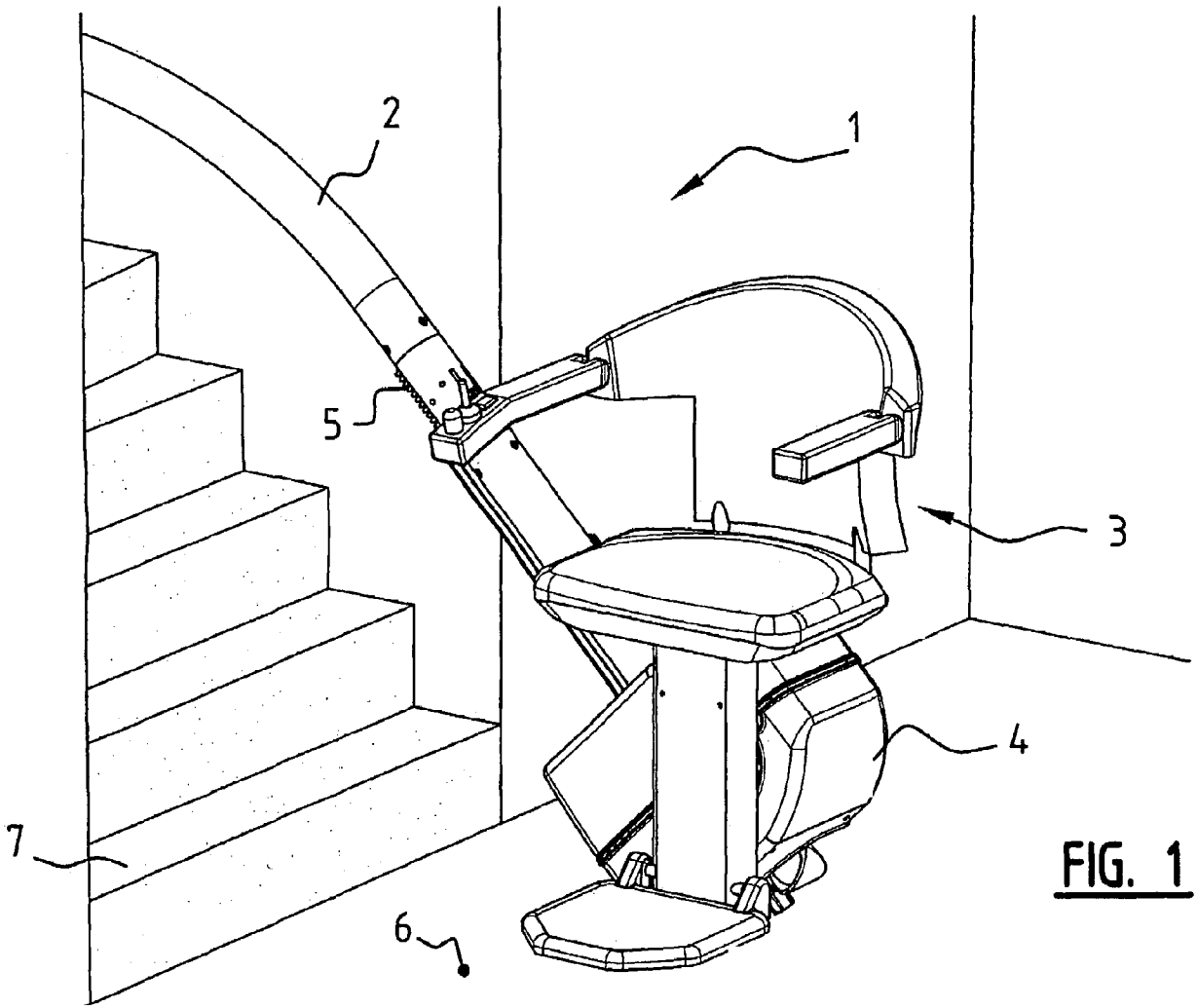
FIG. 1 shows a perspective view of a stair lift 1 with a guide 2, both according to the present invention.

In FIG. 1 stair lift 1 is shown in perspective view as a possible embodiment of the invention. Stair lift 1 comprises a carriage 3 which is displaceable along a guide 2, which guide 2 is per se also designed according to the present invention. Carriage 3 is displaceable along guide 2 using a motor (not shown) in motor casing 4. This motor in motor casing 4 is for instance electric and engages with toothed wheels on gear rack 5 which extends along guide 2.

Figure 2:
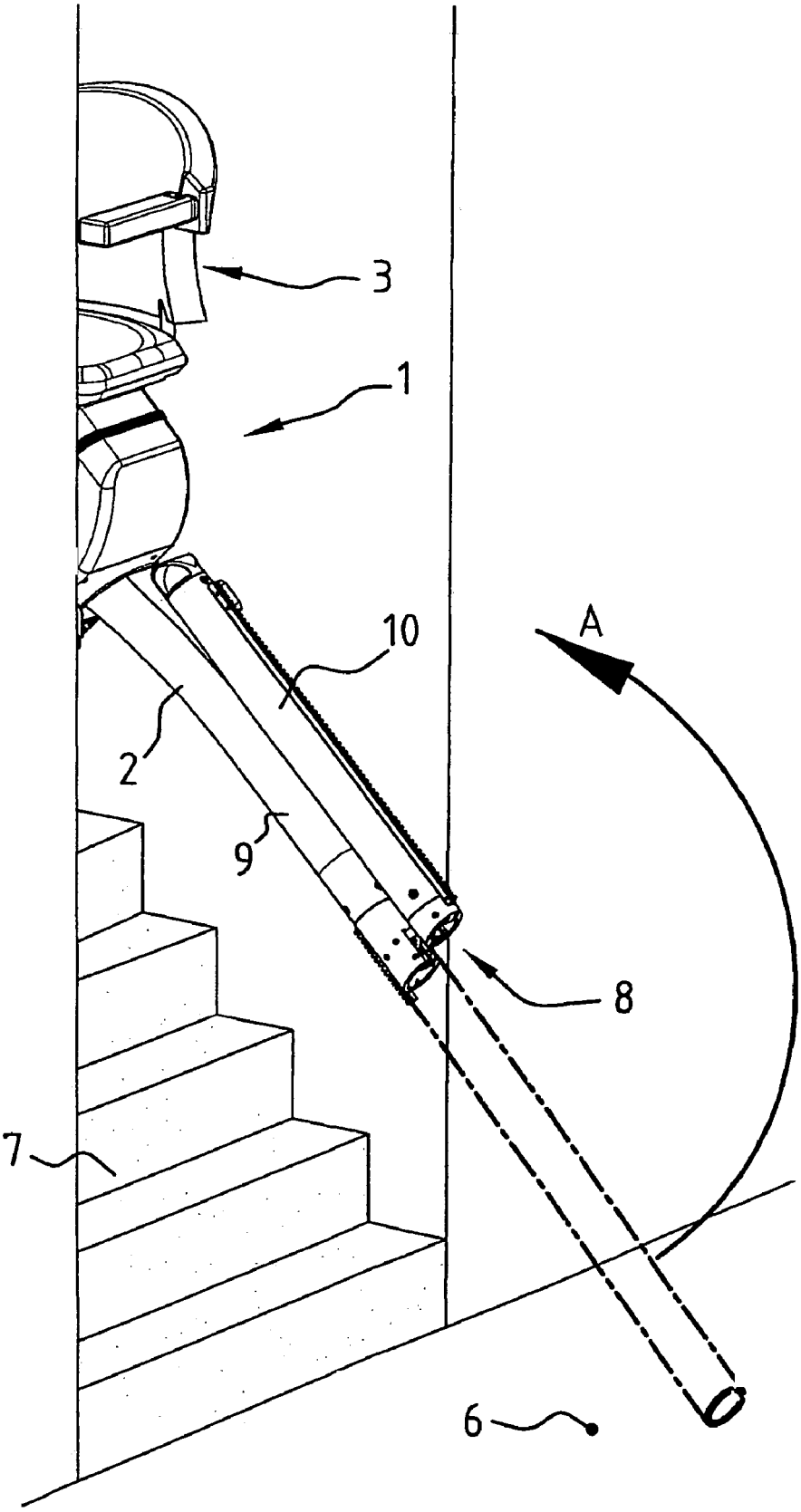
FIG. 2 is a perspective view corresponding with FIG. 1, but wherein a carriage 3, which is displaceable along the guide 2, is displaced upward.

A comparison of FIGS. 1 and 2 will show clearly the problems of such a stair lift 1. When the carriage 3 is moved upward along guide 2, apart of the guide 2 then protrudes into the space 6 for staircase 7 along which stair lift 1, or at least guide 2 thereof, extends. The part of guide 2 protruding into the space in question would represent a hindrance, were it not that guide 2 is provided with a tilting mechanism 8, whereby guide 2 is sub-divided into a stationary segment 9 and a tiltable segment 10. The tiltable segment 10 can be folded back onto stationary segment 9 of guide 2 by means of the tilting mechanism 8 so that tiltable segment 10 no longer forms a hindrance or an obstacle in the space 6 for staircase 7. The tilting movement is indicated in FIG. 2 with arrow A and it can be clearly seen that, in the situation tilted against stationary segment 9, the tiltable segment 10 no longer forms a hindrance or obstacle in the space 6 for staircase 7.

Figure 3:
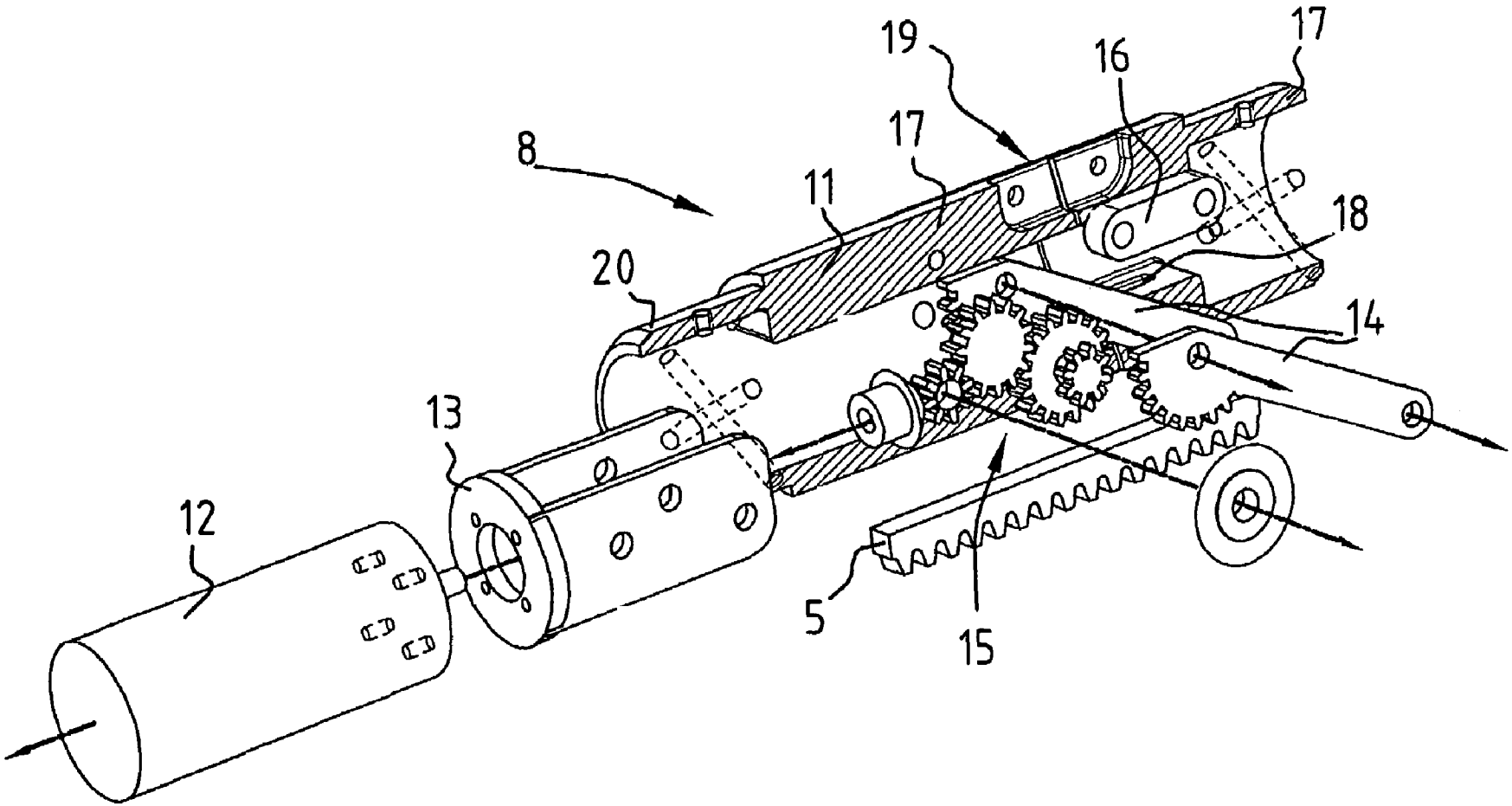
FIG. 3 is a cut-away perspective view of an example of a tilting mechanism for use in the configuration of FIG. 1 and 2.

FIG. 3 shows a cut-away example of a tilting mechanism 8 as can be applied in a guide according to the present invention. Tilting mechanism 8 comprises a housing 11 in which a motor 12, for instance an electric motor, can be accommodated. Motor 12 engages through bracket 13 onto a planetary gear system 15 for transmitting the turning or rotation movement of motor 12 onto arms 14.

Housing 11 consists of two housing parts 17 which are arranged tiltably on each other and which are mutually connected by means of a tilt shaft 16. Arms 14 engage in recesses 18 in the right-hand housing part 17 in FIG. 3 from the left-hand housing part 17 in FIG. 3, where planetary gear system 15 and motor 16 etc. are of course also situated.

The left-hand housing part 17 of housing 11 in the figure is provided with two passages 19 on either side of tilt shaft 16 to allow through arms 14 when proceeding through a tilting movement. As such a tilting movement proceeds under the influence of motor 12, and arms 14 are pivoted upward through the passages via planetary gear system 15, while the right-hand housing part 17 in FIG. 3. is pulled about the tilt shaft 16 and tilted so that it comes to lie against the left-hand housing part 17 in the figure.

It is further noted that housing 11 has narrowed portions 20 on the outer ends in the situation as shown in FIG. 3. These narrowed portions fit respectively into the stationary and tiltable segments of guide 2, and the intermediate part of housing 11 between the narrowed portions 20 preferably has a diameter corresponding with that of guide 2, so that a finish without unevenness can be realized when the tilting mechanism 8 is incorporated between stationary segment 9 and tiltable segment 10 of guide 2. This is particularly favourable in respect of the moving parts, which are not shown and are accommodated in the motor casing 4 and, in such a configuration, are in no way obstructed by tilting mechanism 8, which thus forms an interruption between the tiltable segment 10 and stationary segment 9 of guide 2 but does not impede the moving parts.

The invention is described in the foregoing wherein a drive is incorporated in each case in the tilting mechanism. It is noted that the tilting mechanism can also be actuated manually, for instance in the case of power failure, or even contain no motor drive at all, wherein tilting of the tiltable segment can then only be effected manually.

It is noted that many additional and alternative embodiments are possible within the scope of the present invention as defined in the appended claims. It is thus possible for instance to opt for a transmission other than a planetary gear system, this being a choice which depends substantially on the power to be produced by motor 12. It is likewise possible within the scope of the invention to make a use for instance of a screw spindle which transmits the tilting movement to the tiltable segment via a rod construction. Nor is an embodiment precluded wherein use is made of a memory material to predefine the positions of the tiltable segment. In addition, it is not absolutely essential for the tilting mechanism 8 to comprise a separate housing 11, and the motor, a transmission and arms 14 can also be mounted directly into a tube of guide 2, for instance in stationary segment 9 thereof. Although this is less favourable for assembly purposes, it is not precluded. As shown in FIG. 2, the tiltable segment 10 of guide 2 is folded back fully onto stationary segment 9, but this is not a requirement. In a substantially vertically aligned position the tiltable segment already no longer forms a hindrance in the space for the staircase.

The invention claimed is:

1. A guide along a staircase, along which a stair lift or a stair walking aid can be guided and along which a carriage of the lift or stair walking aid is displaceable, said guide comprising at least one elongate tube and engaging means for the carriage, wherein the tube comprises a stationary segment and at least one tiltable segment which are connected by means of a tilting mechanism in order to tilt the tiltable segment selectively away from and to a position lying in the line of the stationary segment, and wherein the tilting mechanism is situated in the interior of at least one of the tiltable segment and the stationaly segment, wherein the tilting mechanism comprises a housing with an intermediate part between a first narrowed portion and a second narrowed portion, wherein the first narrowed portion fits into the tiltable segment and the second narrowed portion fits into the stationary segment, wherein an external diameter of the intermediate part is substantially similar to an external diameter of the tiltable segment and the stationary segment, wherein the external diameters of the intermediate part, the tiltable segment, and the stationary segment form an outer surface without unevenness, such that the stair lift or stair walking aid can move along and contact time intermediate part, the tiltable segment and the stationary segment.

2. The guide as claimed in claim 1, wherein the tilting mechanism comprises a rotary motor for driving a tilting arm connected to the motor via a planetary gear system.

3. The guide as claimed in claim 1, wherein the tilting mechanism comprises a motor, which is arranged in the stationary segment, and a tilting arm which is to be selectively driven with the motor and which is arranged tiltably on the stationary segment and on the tiltable segment.

4. The guide as claimed in claim 3, wherein the intermediate part or one of the segments comprises at least one passage for the tilting arm during the pivoting movement of the tiltable segment.

5. The guide as claimed in claim 1, further including, between the stationary segment and the tiltable segment, a tilt shaft around which the tiltable segment is tiltable relative to the stationary segment.

6. The guide as claimed in claim 1, wherein narrowed portions on either side of the intermediate part have an external form and dimensions corresponding with the internal form and dimensions of the segments.

7. The guide as claimed in claim 1, wherein the intermediate part of the housing comprises two housing parts arranged tiltably on each other.

8. The guide as claimed in claim 1, wherein the tilting mechanism is designed such that in the folded-away position the tiltable segment lies against the stationary segment.

9. A device for transporting persons and goods along a staircase, such as a stair lift or a stair walking aid, said device comprising a carriage and a guide, wherein the carriage is displaceable along the guide and the guide has the characteristics defined in claim 1.

* * * * *

UNITED STATES PATENT AND TRADEMARK OFFICE

CERTIFICATE OF CORRECTION

PATENT NO. : 7,568,555 B2
APPLICATION NO. : 10/482717
DATED : August 4, 2009
INVENTOR(S) : Vroegindeweij et al.

It is certified that error appears in the above-identified patent and that said Letters Patent is hereby corrected as shown below:

Column 5, Line 9, "stationaly segment" should read -- stationary segment --

Column 5, Line 21, "contact time" should read -- contact the --

Signed and Sealed this

Second Day of February, 2010

David J. Kappos

David J. Kappos
*Director of the United States Patent and Trademark Office*